US005144964A

United States Patent [19]

Demain

[11] Patent Number: 5,144,964

[45] Date of Patent: Sep. 8, 1992

[54] SMOKING COMPOSITIONS CONTAINING A FLAVORANT-RELEASE ADDITIVE

[75] Inventor: Barbu A. Demain, Richmond, Va.

[73] Assignees: Philip Morris Incorporated, Richmond, Va.; Philip Morris Products Inc., New York, N.Y.

[21] Appl. No.: 669,571

[22] Filed: Mar. 14, 1991

[51] Int. Cl.[5] ..... A24B 3/12; A23L 2/26

[52] U.S. Cl. ..... 131/275; 131/276; 131/277; 426/534

[58] Field of Search ..... 131/275, 276, 277; 426/534

[56] References Cited

U.S. PATENT DOCUMENTS 3,047,431 7/1962 Bauley et al. .
3,288,146 11/1966 Bauley et al. .
4,881,555 11/1989 Bolt et al. .

*Primary Examiner*—V. Millin
*Attorney, Agent, or Firm*—James E. Schardt

[57] ABSTRACT

This invention provides smoking compositions which contain a novel flavorant-release additive.

Under cigarette smoking conditions, a combustible filler and/or paper wrapper additive such as a molecular inclusion complex of a $\beta$-cyclodextrin derivative and vanillin releases vanillin as a volatile flavorant component of the cigarette smoke. The released vanillin flavorant improves the taste of the mainstream smoke and imparts a pleasant aroma to the sidestream smoke.

18 Claims, No Drawings

SMOKING COMPOSITIONS CONTAINING A FLAVORANT-RELEASE ADDITIVE

BACKGROUND OF THE INVENTION

A variety of flavorants have been developed and proposed for incorporation into tobacco products. Illustrative of such tobacco flavorants are those described in U.S. Pat. Nos. 3,580,259; 3,625,224; 3,722,516; 3,750,674; 3,879,425; 3,881,025; 3,884,247; 3,890,981; 3,903,900; 3,914,451; 3,915,175; 3,920,027; 3,924,644; 3,937,228; 3,943,943; 3,568,387; 3,379,754; and the like.

J. C. Leffingwell et al. "Tobacco Flavoring For Smoking Products (R. J. Reynolds publication, 1972) recites a listing of desirable flavorants for smoking compositions, which include phenols, terpenols and lactones such as guaiacol, 1-undecanol and 5-dodecalactone.

The high degree of volatility and ease of sublimation of flavorant additives in tobacco products have presented problems in the manufacturing operations, and have resulted in a decreased shelf-life of the products due to losses of flavorant by evaporation on storage.

Recent developments have involved incorporating a low volatility organic additive to a smoking composition, which under smoking conditions is pyrolyzed into one or more fragments that function to improve the taste and character of mainstream tobacco smoke, and in some cases a consequential improvement of sidestream smoke aroma.

U.S. Pat. No. 3,312,226 describes smoking tobacco compositions which contain an ester additive such as l-menthyl linalool carbonate. Under smoking conditions pyrolysis of the carbonate ester releases menthol which flavors the mainstream smoke.

U.S. Pat. No. 3,332,428 and U.S. Pat. No. 3,419,543 describe smoking tobacco compositions which contain a menthyl carbonate ester of a glycol or saccharide, which under smoking conditions decomposes to release free menthol into the mainstream smoke. U.S. Pat. No. 3,499,452 discloses similar smoking tobacco compositions in other than menthol.

U.S. Pat. Nos. 4,119,106; 4,171,702; 4,177,339; and 4,212,310 describe other oligomeric and polymeric carbonate ester derivatives which as constituents of smoking compositions are stable and non-volatile under storage conditions, and are adapted to release pyrolysis products under smoking conditions that improve the taste and aroma of smoke.

U.S. Pat. Nos. 4,036,237; 4,141,906; and 4,178,458 describe β-hydroxyesters which as additives in smoking compositions pyrolyze into volatile aldehyde and ester flavorants under smoking conditions.

Of specific interest with respect to the present invention is the proposed utilization of an organic additive to a cigarette paper wrapper to enhance sidestream smoke aroma under smoking conditions. U.S. Pat. No. 4,804,002 and U.S. Pat. No. 4,941,486 describe a tobacco product wrapper containing a flavorant additive comprising a glycoside of a carbohydrate and phenolic compound. Under cigarette smoking conditions a flavorant additive such as ethyl vanillyl-D-glucoside yields ethyl vanillin and levoglucosan as pyrolysis products.

There is continuing research effort to develop low delivery smoking compositions which generate mainstream smoke with enhanced taste and sidestream smoke with a pleasant aroma under smoking conditions.

Accordingly, it is an object of this invention to provide smoking compositions having incorporated therein a flavorant-release component which is characterized by lack of mobility and/or volatility at ambient temperature.

It is another object of this invention to provide cigarette smoking products having a paper wrapper which has incorporated therein a flavorant-release additive which under normal smoking conditions imparts a pleasant aroma to sidestream smoke.

It is a further object of this invention to provide novel molecular inclusion complex compositions which are adapted to be incorporated into cigarette filler and/or paper wrapper components, and which under normal smoking conditions release a volatile flavorant into cigarette smoke.

Other objects and advantages of the present invention shall become apparent from the following description and examples.

DESCRIPTION OF THE INVENTION

One or more objects of the present invention are accomplished by the provision of a smoking composition comprising an admixture of (1) combustible filler selected from natural tobacco, reconstituted tobacco and tobacco substitutes, and (2) between about 0.0001–5 weight percent, based on the total weight of filler, of a flavorant-release additive which is a water-soluble molecular inclusion complex of a β-cyclodextrin derivative and a lipophilic organic flavorant compound.

In another embodiment this invention provides a cigarette smoking product comprising (1) a combustible filler selected from natural tobacco, reconstituted tobacco and tobacco substitutes, and (2) a paper wrapper which has incorporated therein a flavorant-release additive which is a water-soluble molecular inclusion complex of a β-cyclodextrin derivative and a lipophilic organic flavorant compound.

In another embodiment this invention provides an aqueous solution containing at least about 50 milligrams per milliliter of a molecular inclusion complex of a β-cyclodextrin derivative and a lipophilic organic flavorant compound such as vanillin, ethyl vanillin, bergamot oil or linalool.

A cigarette smoking product with treated paper wrapper in accordance with the present invention typically contains between about 0.01–5 weight percent of flavorant-release additive in the paper wrapper.

In a further embodiment an invention cigarette product contains between about 0.01–5 weight percent of flavorant-release additive in the paper wrapper, and contains between about 0.0001–5 weight percent of flavorant-release additive in the combustible filler, based on the weight of filler.

The β-cyclodextrin derivative consists of a cone-shape ring of seven glucose molecules with a 1–4 linkage. The ring structure of linked glucose units has a three dimensional torus configuration with a hydrophobic cavity (7.5 Å in diameter), and with upper and lower edges that are hydrophilic.

Unsubstituted β-cyclodextrin has a water solubility of only about 20 milligrams per milliliter of water at room temperature. β-cyclodextrin which is substituted with hydroxyalkyl groups has an increased solubility in water. A β-cyclodextrin derivative such as Molecusol HPB TM (Pharmatec, Inc.) or Encapsin HPB TM (American Maize Company) can form an aqueous solution with a concentration of 50% (w/v). The Molecusol HPB TM derivative contains about seven 2-hydroxypropoxy groups. The preferred β-cyclodextrin derivatives of the present invention contain between about 1–7 $C_1$–$C_6$ hydroxyalkyl ether substituents.

A present invention water-soluble molecular inclusion complex contains a lipophilic organic flavorant compound as an essential constituent.

The term "water-soluble" as employed herein refers to a molecular inclusion complex solubility of at least about 50 milligrams per milliliter of water at room temperature. Unsubstituted β-cyclodextrin does not have sufficient water solubility for purposes of the present invention.

The term "lipophilic" as employed herein refers to a flavorant compound which as a component of an aqueous solution of a hydroxyalkyl substituted β-cyclodextrin derivative preferentially concentrates within the hydrophobic cavity of the β-cyclodextrin molecules.

Suitable lipophilic organic flavorant compounds for the practice of the present invention include vanillin, ethyl vanillin, guaiacol, thymol, methyl salicylate, coumarin, linalool, eugenol, menthol, clove, anise, cinnamon, bergamot oil, geranium, lemon oil, spearmint, ginger, and the like.

An aqueous solution of water-soluble molecular inclusion complex is formed by adding calculated amounts of β-cyclodextrin derivative and organic flavorant compound to an aqueous medium. Formation of the molecular inclusion complex of the β-cyclodextrin and flavorant compound can be facilitated by stirring or sonication means. A typical aqueous solution will contain at least about 20 milligrams of complexed flavorant compound per milliliter of solution.

A present invention molecular inclusion complex can be recovered from the aqueous solution in the form of an amorphous powder. Preferably, the original aqueous solution is utilized directly for application to combustible filler and/or cigarette paper wrapper.

PREPARATION OF SMOKING COMPOSITIONS

In a further embodiment the present invention provides a method of preparing a smoking composition which is adapted to impart flavor and aroma to mainstream and sidestream smoke under smoking conditions, which method comprises incorporating into natural tobacco, reconstituted tobacco or tobacco substitute between about 0.0001–5 weight percent, based on composition weight of a flavorant-release additive which is a water-soluble molecular inclusion complex of a β-cyclodextrin derivative and a lipophilic organic flavorant compound The invention flavorant-release additive can be incorporated into the tobacco or tobacco substitute in accordance with methods known and used in the art. Preferably the flavorant-release additive is contained in an aqueous medium and then sprayed or injected into the tobacco and/or tobacco substitute matrix. Such method ensures an even distribution of the flavorant additive throughout the filler, and thereby facilitates the production of a more uniform smoking composition. Alternatively, the flavorant-release additive may be incorporated as part of a concentrated tobacco extract which is applied to a fibrous tobacco web as in the manufacture of reconstituted tobacco. Another suitable procedure is to incorporate the flavorant-release additive in tobacco or tobacco substitute filler in a concentration between about 0.5–5 weight percent, based on the weight of filler, and then subsequently to blend the treated filler with filler which does not contain flavorant-release additive.

The term "tobacco substitute" is meant to include non-tobacco smoking filler materials such as are disclosed in U.S. Pat. Nos. 3,703,177; 3,796,222; 4,019,521; 4,079,742; and references cited therein.

As previously described hereinabove, an invention molecular inclusion complex flavorant-release additive also can be incorporated in the paper wrapper of cigarette products, for the purpose of enhancing the aroma of cigarette sidestream smoke under smoking conditions. The additive can be applied to the paper wrapper in the form of a solution, or a suspension of fine particles, or the additive can be included as an ingredient during the cigarette paper making process.

A further method of incorporating a flavorant-release additive in a cigarette smoking composition is by including the additive as an ingredient in the paper wrapper sideseam adhesive formulation which is employed in cigarette fabrication.

Other means can be utilized for applying the flavorant-release additive to cigarette paper wrapper, such as electrostatic deposition, printing wheel application, size press application, gravure printing, ink jet application, and the like.

A flavorant-release additive in combustible filler and/or cigarette paper wrapper exhibits no evident volatility, and there is no loss of flavorant by evaporation during storage. An additional advantage is that the inclusion state of the flavorant molecules in the complex provides stability for the molecules and protection from adverse reactions such as oxidation.

Under normal smoking conditions the flavorant-release additive in a present invention cigarette product releases volatile flavorant, and the taste and character of the mainstream smoke are enhanced, and a pleasant aroma is imparted to the sidestream smoke and the surrounding environment.

The following Examples are further illustrative of the present invention. The specific ingredients and processing parameters are presented as being typical, and various modifications can be derived in view of the foregoing disclosure within the scope of the invention.

EXAMPLE I

Vanillin (100 mg) is mixed with 2 ml of a 45% w/w aqueous solution of Encapsin HPB TM and sonicated 10 minutes at room temperature to yield a clear, colorless, viscous solution which is stable under room temperature storage conditions. The solution (50 mg/ml vanillin) is applied using a calibrated micropipette in lengthwise stripes on the exterior of the cigarette wrapper of a conventional cigarette. The cigarette is dried at room temperature.

Under smoking conditions, the sidestream smoke of the cigarette has a sweet, vanilla-like odor. The mainstream smoke of the cigarette is enriched with a sweet, aromatic, vanilla-like note.

In a separate procedure, the aqueous solution of the vanillin-Encapsin HPB TM complex is injected lengthwise into the tobacco rod of a conventional cigarette with the microsyringe, and the cigarette is dried at room temperature. The sidestream smoke of the cigarette has a sweet, vanilla-like odor, and the mainstream smoke taste is enriched with a sweet, aromatic, vanilla-like note.

EXAMPLE II

Ethyl vanillin (50 mg) is mixed with 2 ml of a 45% w/w aqueous solution of Encapsin HPB TM and sonicated 10 minutes at room temperature, to yield a clear, colorless, viscous solution which is stable under room temperature storage conditions. The solution (25 mg/ml ethyl vanillin) is applied using a calibrated micropipette in lengthwise stripes on the exterior of the cigarette wrapper of a conventional cigarette, and the cigarette is dried at room temperature.

Under smoking conditions, the sidestream smoke of the cigarette has a sweet, vanilla-like odor, and the mainstream smoke is enriched with a sweet, aromatic, vanilla-like note.

EXAMPLE III

Bergamot oil (40 mg) is mixed with 2 ml of a 45% w/w aqueous solution of Encapsin HPB TM and sonicated 10 minutes at room temperature to provide a pale greenish-yellow viscous solution which is stable under room temperature storage conditions. The solution (20 mg/ml bergamot oil) is applied using a calibrated micropipette in lengthwise stripes on the exterior of the cigarette wrapper of a conventional cigarette. The cigarette is dried at room temperature.

Under smoking conditions, the sidestream smoke of the cigarette has a fresh, fruity odor, and the mainstream smoke taste is enhanced with a fruity, fresh note.

EXAMPLE IV

Linalool (100 mg) is mixed with 2 ml of a 45% w/w aqueous solution of Encapsin HPB TM and sonicated 10 minutes at room temperature, to yield a clear, colorless, viscous solution which is stable under room temperature storage conditions. The solution (50 mg/ml linalool) is applied using a calibrated micropipette in lengthwise stripes on the exterior of the cigarette wrapper of a coventional cigarette. The cigarette is dried at room temperature.

The sidestream smoke of the cigarette has a fresh, fruity, sweet odor, and the mainstream taste is enhanced with a fruity, fresh note.

What is claimed is:

1. A smoking composition comprising an admixture of (1) combustible filler selected from natural tobacco, reconstituted tobacco and tobacco substitutes, and (2) between about 0.0001–5 weight percent, based on the total weight of filler, of a flavorant-release additive which is a water-soluble molecular inclusion complex of a β-cyclodextrin derivative and a lipophilic organic flavorant compound.

2. A smoking composition in accordance with claim 1 wherein the organic flavorant compound is vanillin.

3. A smoking composition in accordance with claim 1 wherein the organic flavorant compound is ethyl vanillin.

4. A smoking composition in accordance with claim 1 wherein the organic flavorant compound is bergamot oil.

5. A smoking composition in accordance with claim 1 wherein the organic flavorant compound is linalool.

6. A smoking composition in accordance with claim 1 wherein the β-cyclodextrin structure is a hydroxyalkyl ether derivative.

7. A cigarette smoking product comprising (1) a combustible filler selected from natural tobacco, reconstituted tobacco and tobacco substitutes, and (2) a paper wrapper having incorporated therein a flavorant-release additive which is a water-soluble molecular inclusion complex of a β-cyclodextrin derivative and a lipophilic organic flavorant compound.

8. A cigarette smoking product in accordance with claim 7 wherein the paper wrapper contains between about 0.01–5 weight percent of flavorant-release additive.

9. A cigarette smoking product in accordance with claim 7 wherein the organic flavorant compound is vanillin.

10. A cigarette smoking product in accordance with claim 7 wherein the organic flavorant compound is ethyl vanillin.

11. A cigarette smoking product in accordance with claim 7 wherein the organic flavorant compound is bergamot oil.

12. A cigarette smoking product in accordance with claim 7 wherein the organic flavorant is linalool.

13. A cigarette smoking product in accordance with claim 7 wherein the β-cyclodextrin structure is a hydroxyalkyl ether derivative.

14. A water-soluble molecular inclusion complex of a β-cyclodextrin derivative and a lipophilic organic flavorant compound.

15. A molecular inclusion complex in accordance with claim 14 wherein the flavorant compound is vanillin, ethyl vanillin, bergamot oil or linalool.

16. An aqueous solution containing at least about 50 milligrams, per milliliter of a molecular inclusion complex of a hydroxyalkyl-substituted β-cyclodextrin derivative and a lipophilic organic flavorant compound.

17. An aqueous solution in accordance with claim 16 wherein the weight content of the flavorant compound in the molecular inclusion complex is at least about 20 milligrams per milliliter of solution.

18. An aqueous solution in accordance with claim 16 wherein the flavorant compound is vanillin, ethyl vanillin, bergamot oil or linalool.

* * * * *

UNITED STATES PATENT AND TRADEMARK OFFICE

CERTIFICATE OF CORRECTION

PATENT NO. : 5,144,964

DATED : September 8, 1992

INVENTOR(S) : Barbu Adrian Demian

It is certified that error appears in the above-identified patent and that said Letters Patent is hereby corrected as shown below:

On the title page: Item [75] Inventors: last name should be --Demian--.

Column 1, lines 41-42, "compositions in other than menthol" should be --compositions in which a carbonate ester additive releases flavorant volatiles other than menthol. --

Signed and Sealed this

Sixteenth Day of November, 1993

*Attest:*

*Attesting Officer*

BRUCE LEHMAN

*Commissioner of Patents and Trademarks*